US010707608B2

(12) United States Patent
Gu et al.

(10) Patent No.: US 10,707,608 B2
(45) Date of Patent: Jul. 7, 2020

(54) POWER INTERFACE, MOBILE TERMINAL, AND METHOD FOR MANUFACTURING POWER INTERFACE

(71) Applicant: GUANGDONG OPPO MOBILE TELECOMMUNICATIONS CORP., LTD., Dongguan, Guangdong (CN)

(72) Inventors: Guodong Gu, Guangdong (CN); Feifei Li, Guangdong (CN)

(73) Assignee: Guangdong Oppo Mobile Telecommunications Corp., Ltd., Dongguan, Guangdong (CN)

( * ) Notice: Subject to any disclaimer, the term of this patent is extended or adjusted under 35 U.S.C. 154(b) by 0 days.

(21) Appl. No.: 16/108,270

(22) Filed: Aug. 22, 2018

(65) Prior Publication Data

US 2018/0358736 A1 Dec. 13, 2018

Related U.S. Application Data

(63) Continuation of application No. PCT/CN2017/081156, filed on Apr. 19, 2017.

(30) Foreign Application Priority Data

Jul. 27, 2016 (CN) ..... 2016 1 0606255
Jul. 27, 2016 (CN) ..... 2016 2 0806350 U

(51) Int. Cl.

| | |
|---|---|
| ***H01R 24/60*** | (2011.01) |
| ***H01R 13/518*** | (2006.01) |
| ***H01R 43/16*** | (2006.01) |
| ***H01R 12/58*** | (2011.01) |
| ***H01R 12/73*** | (2011.01) |
| *H01R 12/72* | (2011.01) |

(52) U.S. Cl.

CPC ..... *H01R 13/518* (2013.01); *H01R 12/58* (2013.01); *H01R 12/732* (2013.01); *H01R 24/60* (2013.01); *H01R 43/16* (2013.01); *H01R 12/722* (2013.01)

(58) Field of Classification Search

CPC ..... H01R 24/60; H01R 12/722
See application file for complete search history.

(56) References Cited

U.S. PATENT DOCUMENTS

| | | | |
|---|---|---|---|
| 4,932,903 A | 6/1990 | Bonhomme | |
| 6,304,455 B1 | 10/2001 | Huber et al. | |
| 9,325,128 B2 * | 4/2016 | Chen | H01R 12/724 |

(Continued)

FOREIGN PATENT DOCUMENTS

| | | |
|---|---|---|
| CN | 103199357 A | 7/2013 |
| CN | 104882705 A | 9/2015 |

(Continued)

OTHER PUBLICATIONS

European Search Report dated Feb. 19, 2019; EP17833254.0.

*Primary Examiner* — Tho D Ta

(57) ABSTRACT

A power interface includes: a connection body having a first connection surface and a second connection surface opposite to the first connection surface; and a plurality of power pins. Each of plurality of power pins has a first portion extending through the connection body from the first connection surface to the second connection surface. A mobile terminal including the power interface and a method for manufacturing the power interface are also disclosed.

20 Claims, 12 Drawing Sheets

(56) References Cited

U.S. PATENT DOCUMENTS

| | | | | |
|---|---|---|---|---|
| 9,537,261 | B2 * | 1/2017 | Chen | H01R 13/642 |
| 9,627,825 | B2 * | 4/2017 | Leng | H01R 24/60 |
| 10,135,196 | B2 * | 11/2018 | Wen | H01R 24/60 |
| 2011/0255224 | A1 | 10/2011 | Van Woensel et al. | |
| 2013/0095701 | A1 | 4/2013 | Golko et al. | |
| 2014/0134887 | A1 | 5/2014 | Soubh et al. | |
| 2014/0335729 | A1 | 11/2014 | Little et al. | |
| 2015/0093936 | A1 | 4/2015 | Little et al. | |
| 2016/0134055 | A1 | 5/2016 | Chen et al. | |
| 2016/0141806 | A1 * | 5/2016 | Guo | H01R 13/504<br>439/607.01 |

FOREIGN PATENT DOCUMENTS

| | | | |
|---|---|---|---|
| CN | 2052826922 | U | 6/2016 |
| CN | 106099459 | A | 11/2016 |
| CN | 205960248 | U | 2/2017 |
| WO | 2011/163260 | A1 | 12/2011 |
| WO | WO2014073749 | A1 | 5/2014 |

* cited by examiner

POWER INTERFACE, MOBILE TERMINAL, AND METHOD FOR MANUFACTURING POWER INTERFACE

CROSS REFERENCE TO RELATED APPLICATIONS

The present application is a continuation-application of International (PCT) Patent Application No. PCT/CN2017/081156 filed Apr. 19, 2017, which claims foreign priorities of Chinese Patent Application No. 201610606255.1, filed on Jul. 27, 2016, and Chinese Patent Application No. 201620806350.1, filed on Jul. 27, 2016, the entire contents of which are hereby incorporated by reference in their entireties.

TECHNICAL FIELD

The described embodiments relate to communication technology, and in particular to a power interface, a mobile terminal, and a method for manufacturing the power interface.

BACKGROUND

With the advancement of times, Internet and mobile communication networks provide a huge number of functional applications. Users can use mobile terminals not only for traditional applications, for example, using smart phones to answer or make calls, but also for browsing web, transferring picture, playing games, and the like at the same time.

While using a mobile terminal to handle things, due to the increase in frequencies of using the mobile terminals, it will consume a large amount of powers of batteries the mobile terminals, such that the batteries need to be charged frequently. Furthermore, due to the acceleration of the pace of life, especially the increasing of sudden and urgencies, the users hopes that the batteries of the mobile terminals are charged with a large current.

BRIEF DESCRIPTION OF THE DRAWINGS

In order to make the technical solution described in the embodiments of the present disclosure more clear, the drawings used for the description of the embodiments will be briefly described. Apparently, the drawings described below are only for illustration but not for limitation. It should be understood that, one skilled in the art may acquire other drawings based on these drawings, without making any inventive work.

DETAILED DESCRIPTION

Figure 1:
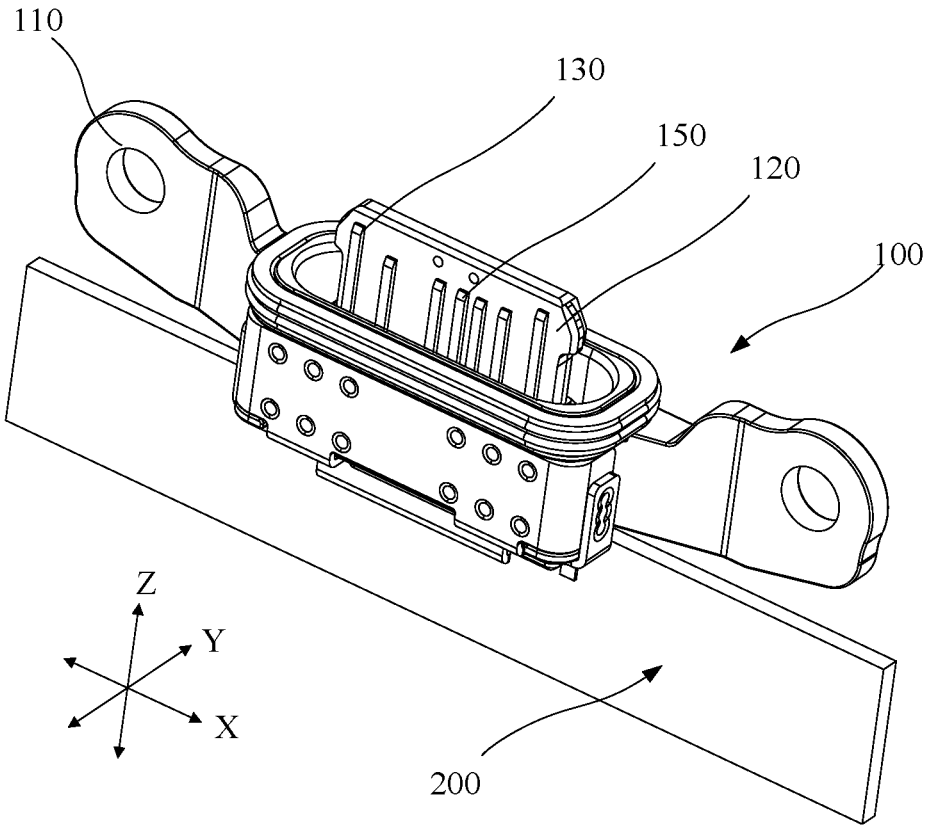
FIG. 1 is a perspective view of a power interface according to one embodiment of the present disclosure.

Embodiments of the present disclosure will be described in detail below, and examples of the embodiments will be illustrated in the accompanying drawings. The embodiments described below with reference to the drawings are illustrative and are intended to explain the present disclosure, and cannot be construed as a limitation to the present disclosure.

In the description of the present disclosure, it is to be understood that terms such as "upper", "lower", "front", "rear", "left", "right", "perpendicular", "horizontal", "top", "bottom", "inner", "outer", "circumference", and the like, refer to the orientations and locational relations illustrated in the accompanying drawings. Thus, these terms used here are only for describing the present disclosure and for describing in a simple manner, and are not intended to indicate or imply that the device or the elements are disposed to locate at the specific directions or are structured and performed in the specific directions, which could not to be understood as limiting the present disclosure.

In addition, terms such as "first", "second", and the like are used herein for purposes of description, and are not intended to indicate or imply relative importance or significance or to imply the number of indicated technical features. Thus, the feature defined with "first", "second", and the like may include one or more of such a feature. In the description of the present disclosure, "a plurality of" means two or more, such as two, three, and the like, unless specified otherwise.

In the present disclosure, unless specified or limited, otherwise, terms "mounted", "connected", "coupled", "disposed", "arranged", and the like are used in a broad sense, and may include, for example, fixed connections, detachable connections, or integral connections; may also be mechanical or electrical connections; may also be direct connections or indirect connections via intervening structures; may also be inner communications of two elements, as can be understood by one skilled in the art depending on specific contexts.

In the following, in one aspect, a power interface 100 electrically connected to a circuit board 200 may be will be described in embodiments of the present disclosure with reference to FIGS. 1-8.

Hereafter, the term "first direction Z" used in the present disclosure may refer to an up-down direction which may be a height direction of the power interface 100. The term "second direction X" used in the present disclosure may refer to a left-right direction which may be a length direction of the power interface 100. The term "third direction Y" used in the present disclosure may refer to a front-rear direction which may be a width direction of the power interface 100. It will be appreciate that the directions defined here are only for explanation, not for limitation.

It should be understood that, the power interface 100 may include an interface configured for charging or data transmission, and may be disposed in a mobile terminal such as a mobile phone, a tablet computer, a laptop, an in-vehicle device, or any other suitable mobile terminal having a rechargeable function. The power interface 100 may be electrically connected to a corresponding power adapter to achieve a communication of electrical signals and data signals. For example, when the power interface 100 is disposed in a mobile terminal having a battery, the battery may be charged by an external power source via the power interface 100.

Figure 2:
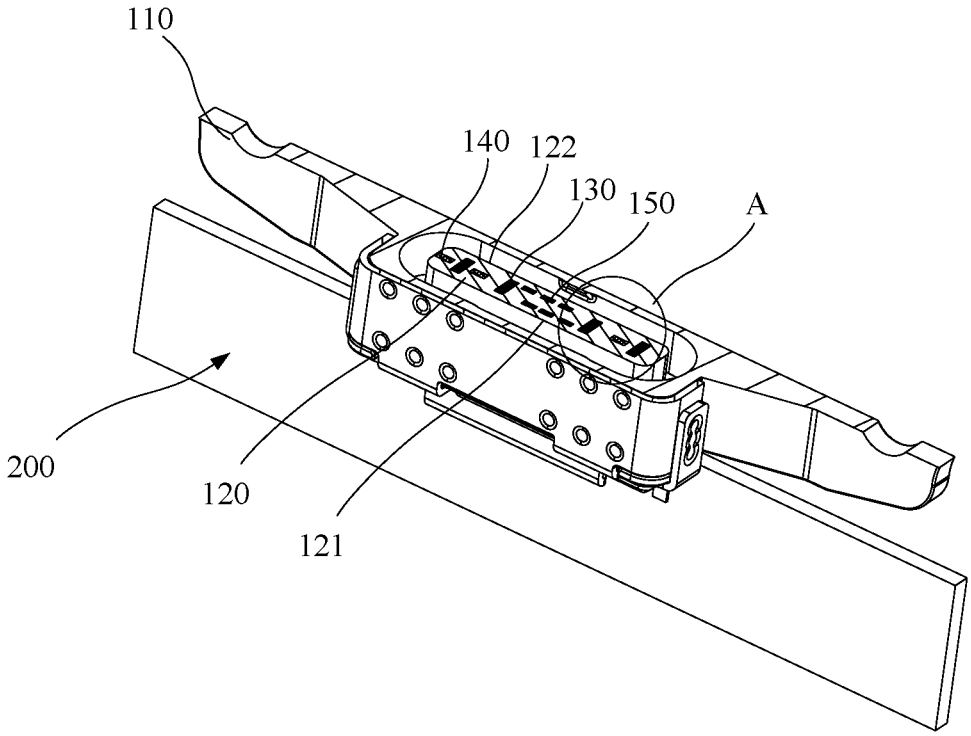
FIG. 2 is a cutaway view of the power interface of FIG. 1.
Figure 3:
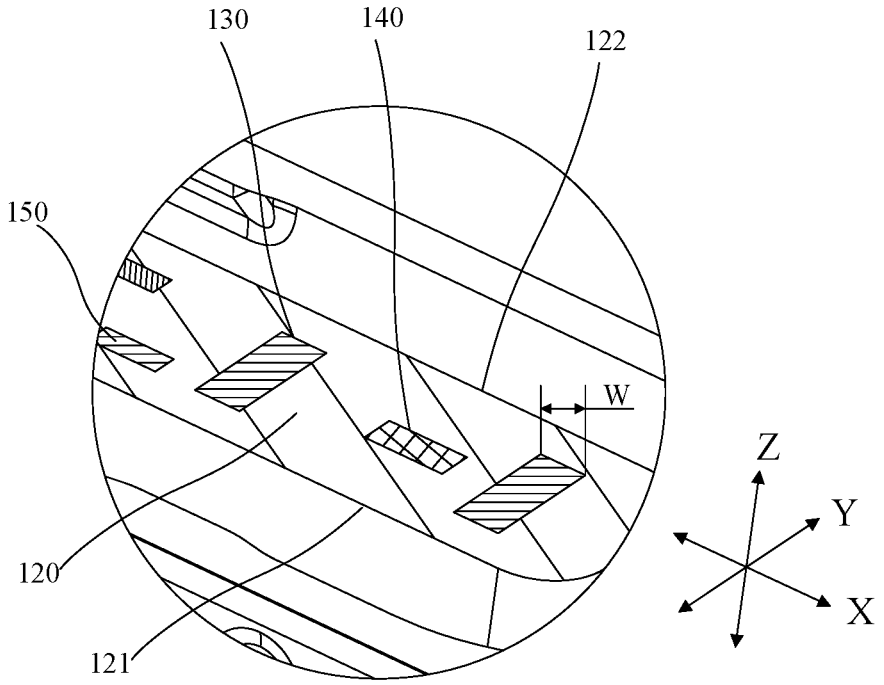
FIG. 3 is a partially enlarged view of portion A of FIG. 2.

FIG. 1 is a perspective view of a power interface 100 according to one embodiment of the present disclosure, FIG. 2 is a cutaway view of the power interface of FIG. 1, and FIG. 3 a partially enlarged view of portion A of FIG. 2. Referring to FIGS. 1-3, the power interface 100 may include a housing 110, a connection body 120 received in the housing 110, and a plurality of power pins 130 embedded in the connection body 120 and partially extending through and beyond the connection body 120. The housing 110 and each power pin 130 may be connected to the circuit board 200.

In one embodiment, the housing 110, also called as a casing, a shell, and the like, may be made of metal. Certainly, it may also possible that the housing 110 is made of plastic materials, such as rubber, resin, and the like. Thus, the material of the housing 110 will not be limited in the present disclosure.

Figure 4:
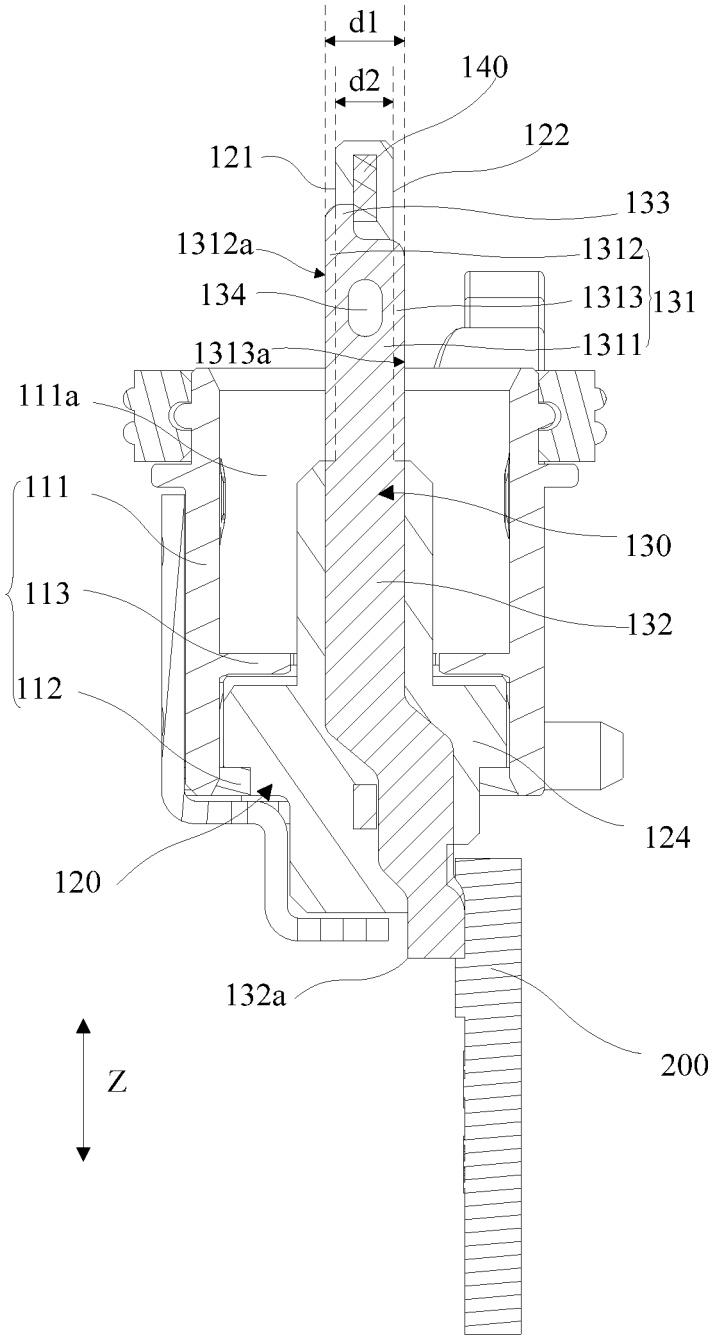
FIG. 4 is a cross-sectional view of the power interface of FIG. 1.
Figure 5:
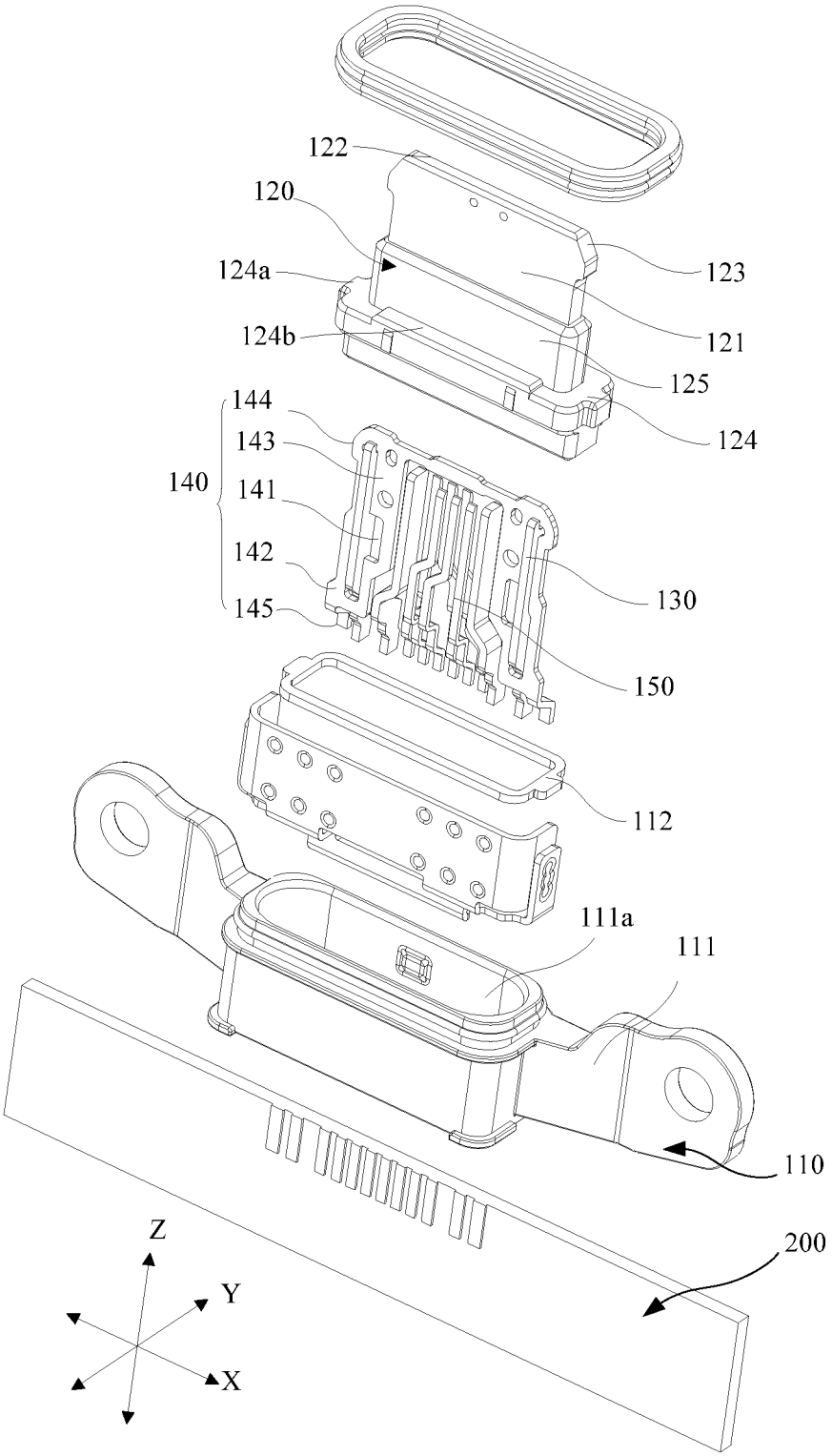
FIG. 5 is an explored view of the power interface as shown in FIG. 1.
Figure 6:
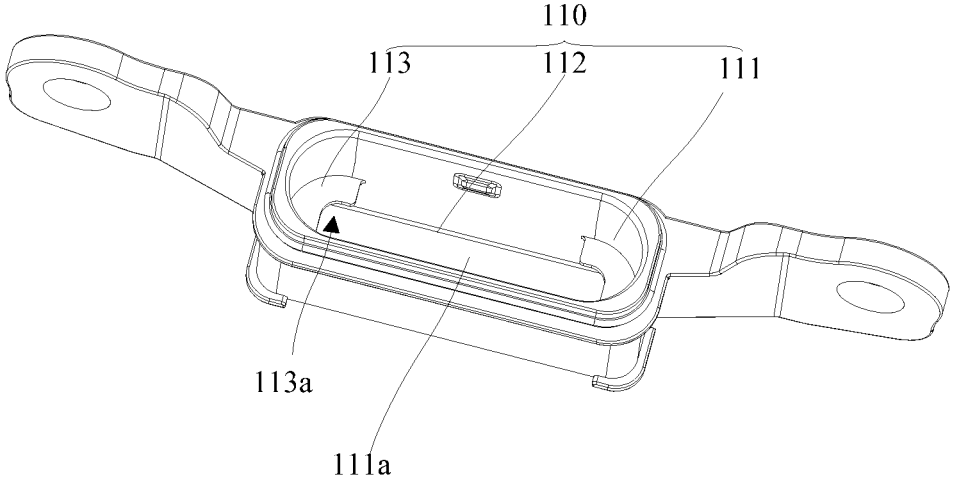
FIG. 6 is a schematic view of a housing according of the power interface to one embodiment of the present disclosure.

FIG. 4 is a cross-sectional view of the power interface of FIG. 1. FIG. 5 is an explored view of the power interface as shown in FIG. 1. FIG. 6 is a perspective view of the housing 110 according to one embodiment of the present disclosure. Referring to FIGS. 4-6, in this embodiment, the housing 110 may include a housing body 111, a first stopping plate 112, and a second stopping plate 113. More specifically, the housing body 111 may define a receiving chamber 111*a*, and the connection body 120 may be received in the receiving chamber 111*a*. Both the first stopping plate 112 and the second stopping plate 113 may also be received in the receiving chamber 111*a*, connected to an inner wall of the housing body 111, and spaced from each other in the first direction Z. The first stopping plate 112 and the second stopping plate 113 may be configured to stop the connection body 120 from moving upwardly or downwardly, thereby preventing the connection body 120 from falling off the housing 110.

Further referring to FIGS. 4-5, the first stopping plate 112 may disposed around a circumference of the connection body 120, and may be in shape of an annulus. In this way, it is possible to ensure that the connection body 120 is firmly fixed in the housing 110.

In this embodiment, only one first stopping plate 112 is provided. However, in other embodiments, it is possible to provide a plurality of first stopping plates 112 respectively connected to the inner wall of the housing body 111. The plurality of first stopping plates 112 may be spaced from each other along the circumferential direction of the connection body 120, and cooperatively form an annular stopping component for stopping the connection body 120 from falling off the housing 110. Therefore, the numbers and extending direction of the first stopping plate 112 will not be limited in the present disclosure.

Referring to FIG. 6, a pair of second stopping plates 113 may be symmetrically connected to the inner wall of the housing body 111 and located around the circumference of the connection body 120. However, in other embodiments, it is also possible to provide only one second stopping plate 113, or more than two second stopping plates 113 spaced from each other along the circumferential direction of the connection body 120. Therefore, the numbers and the extending direction of the second stopping plate 113 will not be limited in the present disclosure.

In this embodiment, the housing body 111, the first stopping plate 112 and the second stopping plate 113 may be made of metal (such as aluminium, stainless steel, and the like). The first stopping plate 112 and the second stopping plate 113 may be connected to the inner wall of the housing body 111 by means of, for example, welding. In this way, it is possible to simplify the processing and assembling processes, shorten manufacturing cycles, and reduce the manufacturing cost. It could be understood that, the first stopping plate 112 and the second stopping plate 113 may be made of other materials, for example, plastic materials, in which case the first stopping plate 112 and the second stopping plate 113 may be injected into the housing body 111. Therefore, the materials and the mounting method of the first stopping plate 112 and the second stopping plate 113 may not be limited in the present disclosure.

The connection body 120 may be made of plastic materials, such as rubbers, resin, and the like. In this way, the connection body 120 may be assembled with the plurality of power pins 130 by means of injection.

Referring back to FIGS. 2-3, the connection body 120 may include a first connection surface 121 and a second connection surface 122 opposite to the first connection surface 121. The first connection surface 121 and the second connection surface 122 may be adapted to connect to corresponding interfaces of a power adapter (not shown).

Referring to FIG. 5, the connection body 120 may further include a pair of third connection surfaces 123 opposite to each other. The pair of third connection surfaces 123 may be connected between the first connection surface 121 and the second connection surface 122, and may be spaced from each other in the second direction X.

Referring to FIGS. 4-5, the connection body 120 may further include an engaging portion 124 and a connection portion 125. The engaging portion 124 may extend around a circumference of the connection portion 125 and may be a protrusion protruding from a corresponding third surface 123, and may be sandwiched between the first stopping plate 112 and the second stopping plate 113, such that the connection body 120 may be prevented from moving upwardly and downwardly, and from falling off the housing 110. In this way, when a connection wire of the power adapter is plugged into the power interface 100, it is possible to improve the reliability of the connection between the connection wire and the power interface 100. In some embodiments, each of the one or more second stopping plates 113 is disposed on the engaging portion 124 and has an opening 113*a* configured to receive the connection portion 125. The power interface may further include a first protrusion 124*a* and a second protrusion 124*b*. The first protrusion 124*a* is arranged at two opposite sides of the engaging portion 124 in the left-right direction (the second direction X) and extends away from the engaging portion 124 in the left-right-direction. The second protrusion 124*b* is arranged at one side of the engaging portion 124 in the front-rear direction (the third direction Y) and extends away from the engaging portion 124 in the un-down direction (the first direction Z).

In the embodiment previously described, two stopping plate (including the first stopping plate 112 and the second stopping plate 113) are provided. However, in other embodiment, it is also possible to provide only on stopping plate. For example, it is possible to provide only the first stopping plate 112 at one end of the housing body 111 that is close to the circuit board 200. In the case that only the first stopping plate 112 is provided, the engaging portion may abut against the first stopping plate 112, such that the engaging portion 124 may be rested or supported on the first stopping plate 112. The first stopping plate 112 is therefore capable of providing a restriction to the position of the connection body 120.

Figure 7:
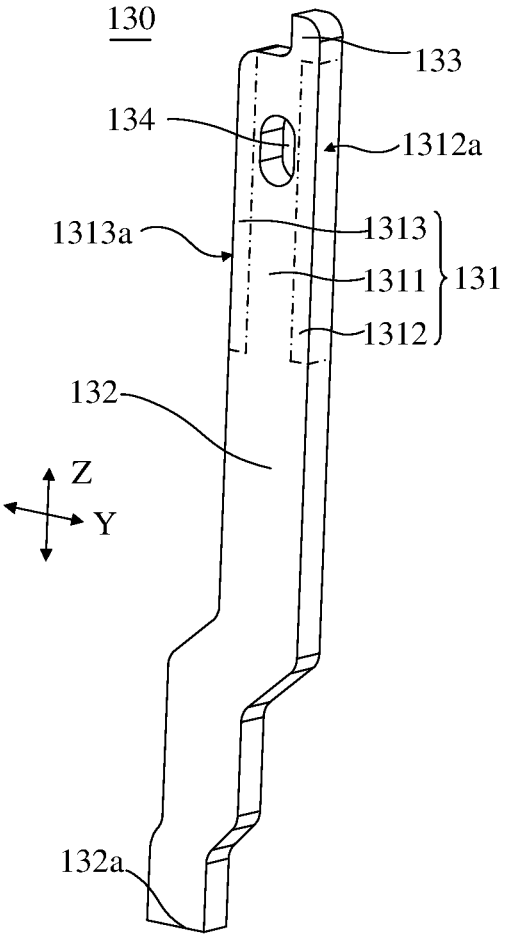
FIG. 7 is a perspective view of the power pin according to one embodiment of the present disclosure.
Figure 8:
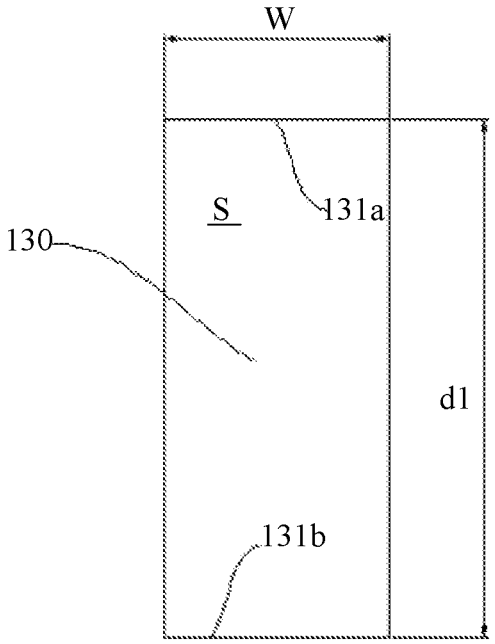
FIG. 8 is a plan view the power pill shown in FIG. 7.

FIG. 7 is a schematic view illustrating each of the plurality of power pins 130 according to one embodiment of the present disclosure, and FIG. 8 is a plan view of portion B of each of the plurality of power pins 130 shown in FIG. 7. Referring to FIGS. 4 and 7, in this embodiment, each of the plurality of power pins 130 may include a first portion 131 and a second portion 132. The first portion 131 may be configured to electrically connect to the power adapter, and may extend through the connection body 120 from the first connection surface 121 to the second connection surface 122. The second portion 132 may extend from an end of the first portion and along a length direction of the first portion. In one embodiment, the second portion is formed integrally with the first portion 131, partially embedded in the connection body 120, and further connected to the circuit board 200.

In one embodiment, at least the first portion 131 may be solid. Herein, the term "solid" is used to indicate that the first portion 131 may be a solid structure or a solid configuration. That is to say, no holes, grooves, or spaces are defined in the first portion 131 to separate the first portion 131 into several separated parts in the third direction Y, and the first portion 131 extends continuously without any hole, groove or space. Alternatively, in other embodiments, the second portion 132 may also be solid, that is to say, the whole power pin 130 may be solid.

In this embodiment, as shown in FIGS. 4 and 7, the first portion 131 may partially extend beyond the connection body 120. In this case, more specifically, the first portion 131 may include an embedding part 1311, a first extending part 1312 and a second extending part 1313. The embedding part 1311 may be completely received or embedded in the connection body 120. The first extending part 1312 and the second extending part 1313 may be formed integrally and continuously on two opposite sides of the embedding part 1311 that are spaced from each other in the second direction X.

Further, the first extending part 1312 may include a first outer surface 1312*a*, and the second extending part 1313 may include a second outer surface 1313*a* opposite to the first outer surface 1312*a*. More specifically, the first outer surface 1312*a* may be located at one side of the connection body 120, and the second outer surface 1313*a* may be located at the other side of the connection body 120.

Further referring to FIG. 4, the first portion 131 may extend through the connection body 120 from the first connection surface 121 to the second connection surface 122, such that the first outer surface 1312*a* may extend beyond the first connection surface 121, and the second outer surface 1313*a* may extend beyond the second connection surface 122. Therefore, when the power interface 100 is connected to the power adapter, each of the plurality of power pins 130 may be electrically connected to the corresponding pin of the power adapter.

More specifically, as is further shown in FIG. 4, in this embodiment, a first distance d1 from the first outer surface 1312*a* to the second outer surface 1313*a* may be greater than a second distance d2 from the first connection surface 121 to the second connection surface 122; that is, $d1>d2$.

FIG. 8 is a plan view of portion B of each of the plurality of power pins 130 shown in FIG. 7. Referring to FIGS. 7-8, a cross-sectional area of the first portion 131 of each of the plurality of power pins 130 may be defined as S. Alternatively, in one embodiment, $S\geq0.09805\ mm^2$. In the condition that $S\geq0.09805\ mm^2$, the current-carrying amount of the plurality of power pins 130 is at least 10 A, and the charging efficiency can be improved by increasing the current-carrying amount of the plurality of power pins 130. Alternatively, in another embodiment, $S=0.13125\ mm^2$; in this case, the current-carrying amount of the plurality of power pins 130 is at least 12 A, which can improve the charging efficiency. Alternatively, in a further embodiment, it is also possible that $S=0.175\ mm^2$.

According to an embodiment of the present disclosure, referring to FIGS. 7-8, the first distance d1 from the first outer surface 1312*a* to the second outer surface 1313*a* may be less than or equal to 0.7 mm, that is $d1\leq0.7$ mm. In this case, the first distance d1 may be regarded as a maximum thickness of each of the plurality of power pins 130. Herein, the thickness refers to the width of each of the plurality of power pins 130 in the third direction Y as shown in FIG. 7.

It should be noted that, in order to improve the universality of the power interface 100, the structural design of the power interface 100 needs to meet certain design standards. For example, in the design standard of the power interface 100, if the maximum thickness of the power interface 100 is h, then during the designing process of the power pins 130, the maximum thickness or the first distance d1 of each of the plurality of power pins 130 needs to be equal to or less than h. In the condition that $d1\leq h$, the greater the thickness or the first distance d1 of each of the plurality of power pins 130 is, the greater the amount of current that each of the plurality of power pins 130 can carry, and the higher the charging efficiency of the power interface 100 is. For example, taking an USB Type-C interface as an example, the design standard for the thickness of the USB Type-C interface is $h=0.7$ mm. Thus, when designing the power interface 100, it is required to set $d1\leq0.7$ mm. Therefore, not only can the power interface 100 meet the general requirements, but also the cross-sectional area of each of the plurality of power pins 130 can be increased. In this way, the current-carrying amount of the plurality of power pins 130 can be increased, thereby improving the charging efficiency.

According to an embodiment of the present disclosure, at least one of the plurality of power pins 130 has a width W in the third direction Y satisfying the following condition: $0.24\ mm\leq W\leq0.32$ mm. In the condition that $0.24\ mm\leq W\leq0.32$ mm, the cross-sectional area of the first portion 131 of each of the plurality of power pins 130 can be maximized, which may in turns increase the current-carrying amount of the plurality of power pins 130, thereby improving the charging efficiency. Alternatively, it is possible that W=0.25 mm. In the case that W=0.25 mm, the current-carrying amount of the plurality of power pins 130 is at least 10 A. Thus, the charging efficiency may be improved by increasing the current-carrying amount of the plurality of power pins 130.

Alternatively, referring to FIGS. 7-8, in the condition that W=0.25 mm, S=0.175 $mm^2$, and d1≤0.7 mm, the current-carrying amount of the plurality of power pins 130 may be greatly increased, and the charging efficiency may be improved. In this embodiment, the current-carrying amount of the plurality of power pins 130 may be 10 A, 12 A, 14 A or more.

According to one embodiment of the present disclosure, each of the plurality of power pins 130 may be an integral component, or also called as an one-piece component, and no groove is defined in each of the plurality of power pins 130 to separate each of the plurality of power pins 130 in the third direction Y (referring to FIG. 7). In this way, on one hand, it is possible to simplify the processing of each of the plurality of power pins 130, shorten the production cycle, and save the manufacturing cost. On the other hand, it is also possible to increase the cross-sectional area of each of the plurality of power pins 130, thereby increasing the current-carrying amount of the plurality of power pins 130.

In the power interface 100 of one embodiment of the present disclosure, as is previously described, each of the plurality of power pins 130 is a solid structure, or a solid bar. That is to say, a pair of power pins spaced from each other in the third direction Y in the related art and configured to connect to two opposite pins of the power adapter may be integrated with each other to form one power pin described in the present disclosure. Besides, the first outer surface 1312*a* and the second outer surface 1313*a* may respectively extend beyond the corresponding connection surfaces of the connection body 120, such that the first outer surface 1312*a* and the second outer surface 1313*a* may be electrically connected to the power adapter. In this way, the cross-sectional area of the first portion 131 may be increased, thereby increasing the current-carrying amount of each of the plurality of power pins 130, and in turn increasing the transmission speed of the current, such that the power interface 100 is capable of having a fast charging function, and thus the charging efficiency of the battery may be improved.

As is shown in FIGS. 4 and 7, in this embodiment, the second portion 132 may include a first coupling end 132*a* configured to couple to the circuit board 200. The first coupling end 132*a* may be disposed at one end of the second portion 132 that is away from the first portion 131.

Alternatively, in one embodiment, referring to FIGS. 4 and 7, each power pin 130 may further include a head end 133. The head end 133 may be disposed at one end of each of the plurality of power pins 130 that is opposite to the first coupling end 132*a*.

Alternatively, in another embodiment, each power pin 130 may further include a through-hole 134 extending through each power pin 130 from the first outer surface 1312*a* to the second outer surface 1313*a* in the third direction Y. The through-hole 134 may be configured to facilitate the injection forming of the connection body 120, when the connection body 120 is formed on the plurality of power pins 130 by means of injection. In this embodiment, the through-hole 134 may be defined in a position near the head end 133. However, in other embodiment, the through-hole 134 may be defined in any suitable position in each power pin 130.

Figure 9:
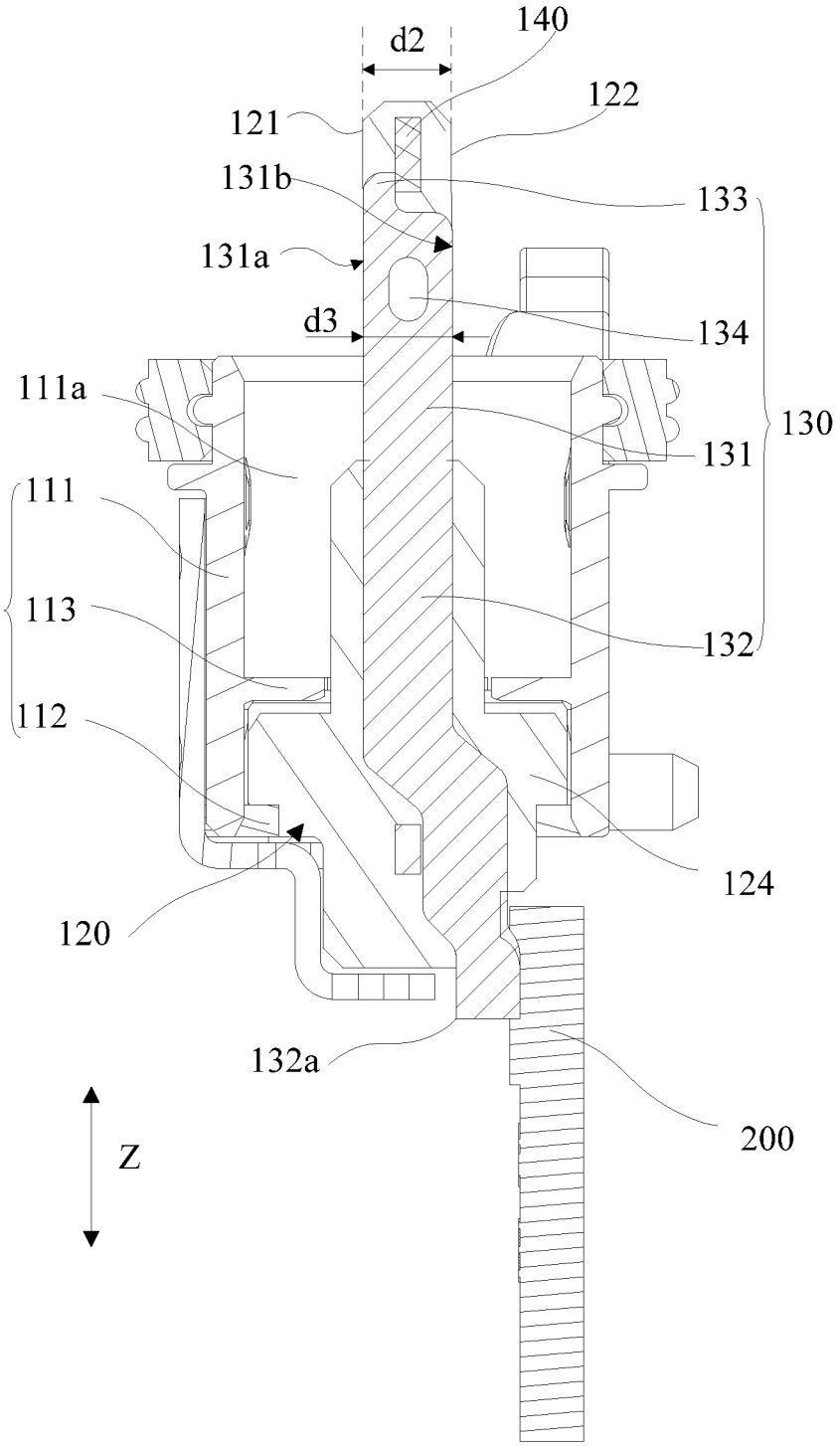
FIG. 9 is a cross-sectional view of the power pin according to another embodiment of the present disclosure.

In the above embodiment described with reference to FIG. 4, the first portion 131 may extend beyond the connection body 120. However, in other embodiment, it is also possible that the first portion 131 completely embedded in the connection body 120. FIG. 9 is a cross-sectional view of the power interface according to another embodiment of the present disclosure. Referring to FIG. 9, in another embodiment, each power pin 130 may also include a first portion 131, a second portion 132, a head end 133 and a through-hole 134.

More specifically, in this embodiment, as shown in FIG. 9, the whole the first portion 131 may be completely embedded in the connection body 120. In this embodiment, the first portion 131 may include a third outer surface 131*a* and a fourth outer surface 131*b* opposite to the third outer surface 131*a*. The third outer surface 131*a* may be located at one side of the connection body 120, and the fourth outer surface 131*b* may be located at the other side of the connection body 120. The third outer surface 131*a* may substantially flush with the first connection surface 121, and the fourth outer surface 131*b* may substantially flush with the second connection surface 122. More specifically, in this embodiment, a third distance d3 from the third outer surface 131*a* to the fourth outer surface 131*b* may be equal to a second distance d2 from the first connection surface 121 to the second connection surface 122; that is, d3=d2.

Other configurations of each power pin, such as the configurations of the second portion 132, the head end 133 and the through-hole 134, the cross-sectional area of the first portion 131, the maximum thickness, the width, and the like in this embodiment substantially the same as those in the embodiments shown in FIG. 4, and will not be described in details any more.

Figure 10:
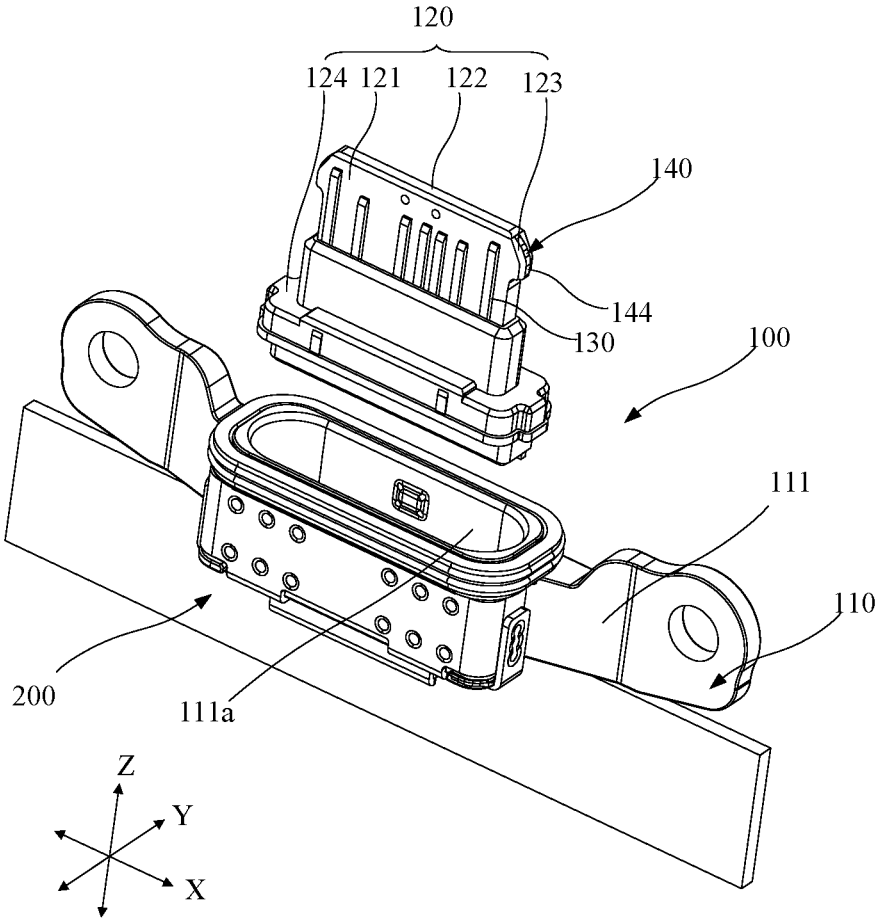
FIG. 10 is another explored view of the power interface as shown in FIG. 1.

In this embodiment, referring to FIGS. 5 and 10, the power interface 100 may further include a frame 140 defining a receiving groove 141, and the plurality of power pins 130 are received in the receiving groove1 141. In this embodiment, when each of the plurality of power pins 130 include the head end 133, the head end 133 may contact with or abut against the frame body 142 of the frame 140. Alternatively, in one embodiment, the head end 133 may contact with or abut against a surface of the frame body 142 that is oriented towards the first connection surface 121.

More specifically, in this embodiment, as shown in FIGS. 5 and 10, the frame 140 and the plurality of power pins 130 received in the frame 140 may be partially embedded in the connection body 120, and wrapped or covered by the connection body 120. Alternatively, the frame 140 may be made of hard materials, such that the frame may be a hard frame. In this way, the frame 140 may support the connection body 120, and help with increasing a structural strength of the connection body 120 and reducing fatigue damage to the connection body 120 due to the repeated insertion and removal of the power interface 100.

Figure 11:
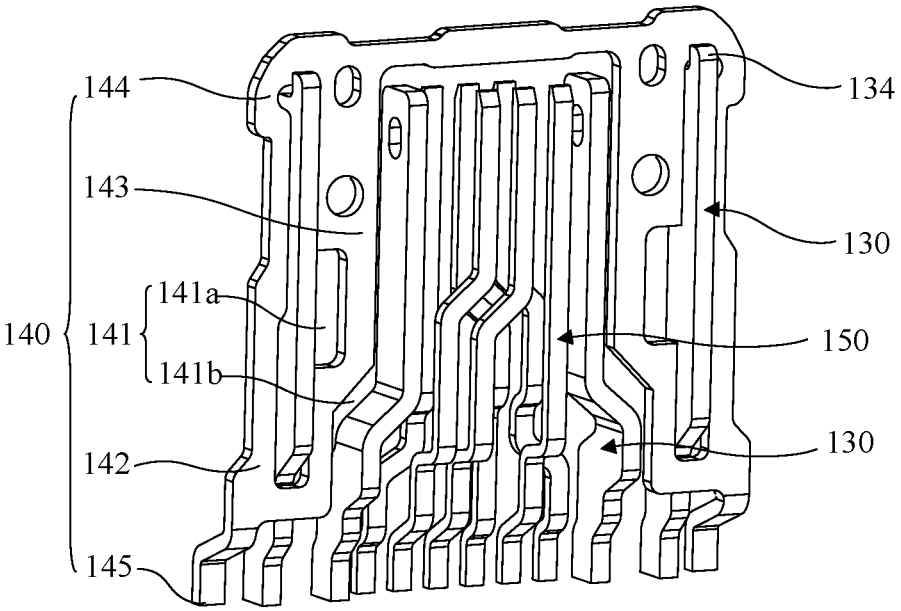
FIG. 11 is a perspective view illustrating the frame, the power pins and the data pins according to one embodiment of the present disclosure.

Referring to FIGS. 5 and 10-11, in one embodiment, the frame 140 may include a frame body 142 and a pair of reinforcements 143 disposed in the frame body 142 and further connected to the frame body 142. The frame 142 may define the defining the receiving groove 141. The receiving groove 141 may be divided into a pair of first sub groove 141*a* and a second sub groove 141*b* by the pair of reinforcements 143. More specifically, referring to FIG. 11, each first sub groove 141*a* may be defined and enclosed (or surrounded) by a corresponding reinforcement and the frame body 142. That is to say, each first sub groove 141*a* may have be closed in the circumferential direction. The second sub groove 141*b* may be defined by the pair of reinforcements and the frame body 142, and may have an opening.

In this embodiment, as shown in FIGS. 10-11, one of the plurality of power pins 130 may be received in each first sub groove 141*a*, and the others of the plurality of power pins 130 may be received in the second sub groove 141*b*. Certainly, it is also possible that, two or more of the plurality of power pins 130 may be received in each first sub groove 141*a*, or even all of the plurality of power pins 130 may be received in each first sub groove 141*a*. The arrangement of the plurality of power pins 130 in the frame 140 may not be limited here.

The embodiments described with reference to FIGS. 10-11 include a pair of reinforcements. However, in another embodiment, it is also possible that only one reinforcement or at least three reinforcements may be provided in the frame body 142. Correspondingly, only one first sub groove 141*a* or at least three first sub grooves 141*a* may also be defined, or at least two second sub grooves 141*b* may also be defined. In a further embodiment, it is also possible that no reinforcement is provided in the frame body 142, and all of the plurality of power pins 130 are received in the receiving groove 141 in this case. Therefore, the numbers of the reinforcements, the first sub groove 141*a*, and the second sub groove 141*b* may not be limited in the present disclosure.

Referring to FIGS. 10-11, the frame 140 may further include at least one protrusion 144 defined at each of two ends of the frame body 142 that are spaced from each other in the second direction X. The at least one protrusion 144 may further protrude out of the connection body 120 from at least one of the pair of third connection surfaces 123. In this way, when the power interface 100 is connected to the power adapter, the at least one protrusion 144 may apply a pressure to the power adapter, such that the power interface 100 and the power adapter may be firmly connected to each other, and the stability and reliability of the connection between the power interface 100 and the power adapter may be improved. Alternatively, the frame 140 may further include a second coupling end 145 configured to couple to the circuit board 200. In this embodiment, the second coupling end 145 may formed on the frame body 142. The at least one protrusion 144 may be arranged at one end of the frame 140 that is away from the second coupling end 145.

Certainly, in other embodiments, the at least one protrusion may also be formed in other locations. For example, the at least one protrusion may be formed in at an upper surface opposite to the second coupling end 145. The location of the at least one protrusion may not be limited in the present disclosure.

Referring back to FIGS. 5 and 11, the power interface 100 may further include a plurality of data pins 150 spaced from each other and electrically connected to the circuit board 200. The plurality of data pins 150 may be also received in the receiving groove 141 of the frame 140, and wrapped by the connection body 120. More specifically, in this embodiment, as shown in FIG. 11, the plurality of data pins 150 may be received in the second sub groove 141*b*. Of course, it is also possible that the plurality of data pins 150 are received in the first sub groove 141*a*.

In one embodiment, the power interface 100 may be implemented as a Type-C interface. The Type-C interface may also be called an USB Type-C interface. The Type-C interface belongs to a type of an interface, and is a new data, video, audio and power transmission interface specification developed and customized by the USB standardization organization to solve the drawbacks present for a long time that the physical interface specifications of the USB interface are uniform, and that the power can only be transmitted in one direction.

The Type-C interface may have the following features: a standard device may declare its willing to occupy a VBUS (that is, a positive connection wire of a traditional USB) to another device through a CC (Configuration Channel) pin in the interface specification. The device having a stronger willing may eventually output voltages and currents to the VBUS, while the other device may accept the power supplied from the VBUS bus, or the other device may still refuse to accept the power; however, it does not affect the transmission function. In order to use the definition of the bus more conveniently, a Type-C interface chip (such as LDR6013) may generally classify devices into four types: DFP (Downstream-facing Port), Strong DRP (Dual Role Power), DRP, and UFP (Upstream-facing Port). The willingness of these four types to occupy the VBUS bus may gradually decrease.

In this embodiment, the DFP may correspond to an adapter, and may continuously want to output voltages to the VBUS. The Strong DRP may correspond to a mobile power, and may give up outputting voltages to the VBUS only when the strong DRP encounters the adapter. The DRP may correspond to a mobile phone. Normally, the DRP may expect other devices to supply power to itself. However, when encountering a device that has a weaker willingness, the DRP may also output the voltages and currents to the device. The UFP will not output electrical power externally. Generally, the UFP is a weak battery device, or a batteryless device, such as a Bluetooth headset. The USB Type-C interface may support the insertions both from a positive side and a negative side. Since there are four groups of power sources and grounds on both sides (the positive side and the negative side), the power supported by USB Type-C interface may be greatly improved.

In this embodiment, as is previously described, the power interface 100 may be the USB Type-C interface. The power interface 100 may be suitable for a power adapter having a fast charging function, and also suitable for an ordinary power adapter. Here, it should be noted that, the fast charging may refer to a charging state in which the charging current is greater than or equal to 2.5 A, or a charging state in which the rated output power is no less than 15 W. The ordinary charging may refer to a charging state in which the charging current is less than 2.5 A, or the rated output power is less than 15 W. That is, when the power interface 100 is charged by using is the power adapter having the fast charging function, the charging current is greater than or equal to 2.5 A, or the rated output power is no less than 15 W. However, when the power interface 100 is charged by using the ordinary power adapter, the charging current is less than 2.5 A, or the rated output power is less than 15 W.

In order to standardize the power interface 100 and the power adapter adapted to the power interface 100, the size of the power interface 100 needs to meet the design requirements of the standard interface. For example, for the power interface 100 having 24 pins, the width meeting the design requirements (the width refers to the length of the power interface 100 in the third direction, as shown in FIG. 1) is a. In order to make the power interface 100 in the present embodiment satisfy the design standard, the width of the power interface 100 in the present embodiment (the width refers to the length of the power interface 100 in the second direction Y, as shown in FIG. 7) is also a. In order to enable the power pin to carry a large charging current in a limited space, a pair of power pins spaced from each other in the third direction Y in the related art may be integrated with each other to form an one-piece power pin described in the present disclosure. In this way, on one hand, it is convenient to optimize the arrangement of the components of the power interface 100. On the other hand, the cross-sectional area of the power pin may be increased, such that the power pin may carry a larger amount of current.

In one embodiment, the power interface 100 may include the housing 110, the connection body 120 and a plurality of power pins 130, as is previously described. Therefore, the specific configuration respectively of these components will not be descried in details any more.

In another aspect, a mobile terminal may be provided. The mobile terminal may include the power interface 100 as described in the embodiments above. The mobile terminal may be a mobile phone, a tablet computer, a laptop, an in-vehicle device, or any other mobile terminal having a rechargeable function. The mobile terminal may achieve a transmission of the electrical signals and data signals via the power interface 100. For example, the mobile terminal may be charged or a data transmission function may be achieved by electrically connecting the power interface 100 to a corresponding power adapter.

In still another aspect, a power adapter may be provided. The power adapter may include the power interface 100 as described in the embodiments above. Likewise, the power adapter may achieve a transmission of the electrical signals and data signals via the power interface 100.

Figure 12:
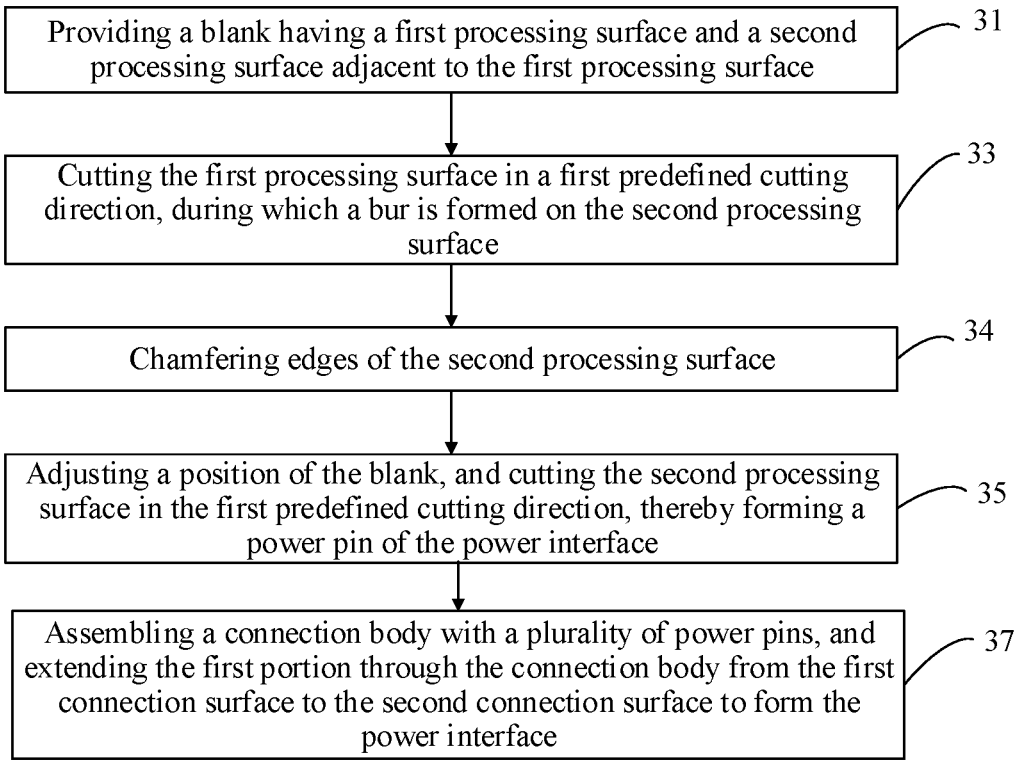
FIG. 12 is a flow chart illustrating a method for manufacturing the power interface according to one embodiment of the present disclosure.
Figure 13:
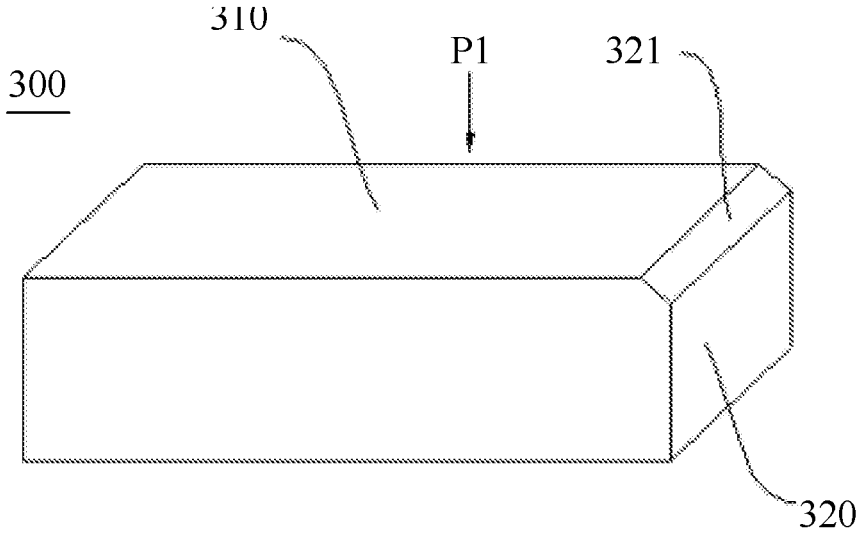
FIG. 13 is a perspective view of the blank for manufacturing the power pin according to one embodiment of the present disclosure.

In yet another aspect, a method for manufacturing the power interface may be provided. FIG. 12 is a flow chart illustrating a, method for manufacturing the power interface according to one embodiment of the present disclosure. FIG. 13 is a schematic view of the blank for manufacturing the power pin according to one embodiment of the present disclosure. In this embodiment, the power interface manufactured by the method is the power interface 100 described in the above embodiments, and may include a connection body 120 and a plurality of power pins 130. More specifically, referring to FIGS. 4 and 9, the connection body 120 may have a first connection surface 121 and a second connection surface 122 opposite to the first connection surface 121. Each of the plurality of power pin 130 may include a solid first portion 131 extending through the connection body 120 from the first connection surface 121 to the second connection surface 122. In one embodiment, as shown in FIG. 4, the first portion 131 may extend beyond the connection body 120, and may include the first outer surface 1312*a* located at one side of the connection body 120 and the second outer surface 1313*a* opposite to the first outer surface 1312*a* and located at the other side of the connection body. The first outer surface 1312*a* may extend beyond the first connection surface 121, and the second outer surface 1313*a* may extend beyond the second connection surface 122. In another embodiment, as shown in FIG. 9, the first portion 131 may be completely embedded in the connection body 120, and may include the third outer surface 131*a* and the fourth outer surface 131*b* opposite to each other. The third outer surface 131*a* may extend beyond the first connection surface 121, and the fourth outer surface 131*b* may extend beyond the second connection surface 122.

Referring to FIGS. 12-13, the method in this embodiment may include the following blocks.

At block 31: a blank 300 may be provided. The blank 300 may be made of metal and used to manufacture a power pin, and may include a first processing surface 310 and a second processing surface 320 adjacent to the first processing surface 310.

At block 33: the first processing surface 310 may be cut ill a first predefined cutting direction P1, and a bur may be formed on the second processing surface 320 during the cutting process of the first processing surface 310. In this embodiment, the first processing surface 310 may be cut by means of fine blanking. Of course, in other embodiments, the first processing surface 310 may be cut by means of other cutting methods.

At block 35: a position of the blank 300 may be adjusted, and the second processing surface 320 may be further cut in the first predefined cutting direction P1, thereby forming the power pin 130 of the power interface 100. In this embodiment, likewise, the second processing surface 320 may also be cut by means of fine blanking.

At block 37: after a plurality of power pins 130 have been formed, the power interface 100 may be further formed by assembling the connection body 120 with the plurality of power pins 130, and extending the first portion 131 through the connection body 120 from the first connection surface 121 to the second connection surface 122.

In one embodiment, the connection body 120 may be made of plastic material as previously described, and may be formed on the plurality of power pins 130 and may be assembled with the plurality of power pins 130 by means of injection. For example, it is possible to place the plurality of power pins 130 in a mold, and plastic materials may be injected into the mold, such that the plastic materials may be formed into the connection body 120 surrounding or wrapping the plurality of power pins 130.

In another embodiment, it is also possible that the connection body 120 is formed beforehand, and the plurality of power pins 130 may be disposed or inserted into the connection body 120. Therefore, the assembly method of the connection body 120 to the plurality of power pins will not be limited in the present disclosure.

In the method for manufacturing the power interface 100 according to the embodiment of the present disclosure, different surfaces of the blank 300 are processed by means of fine blanking. In this way, it is possible to not only improve the manufacturing accuracy of the power pin 130, but also omit the process of removing burs. Thus, the manufacturing cycle of the power interface may be shortened, and the manufacturing cost may be saved.

In one embodiment of the present disclosure, before the block 35, the method may further include the following block.

At block 34: edges of the second processing surface 320 may be chamfered, such that a chamfer 321 (as shown in FIG. 13, the chamfer 321 refers to an inclined surface) may be formed at the edges. It should be noted that, during the fine blanking process, burs may be easily formed at the edges of the blank by excess materials. By chamfering the edges of the second processing surface 320, on one hand, it is possible to improve the surface smoothness of the power pin. On the other hand, during the fine blanking process, the excess materials may be filled into the chamfer 321, thereby reducing the production of burrs.

In another embodiment of the present disclosure, the edges of the second processing surface 320 may be rounded. Therefore, in this embodiment, before the block 35, the method may further include the following block.

At block 34*a*: edges of the second processing surface 320 may be rounded, such that a round fillet may be formed at the edges. It should be noted that, during the fine blanking process, burs may be easily formed at the edges of the blank by excess materials. By rounding the edges of the second processing surface 320, on one hand, it is possible to improve the surface smoothness of the power pin. On the other hand, during the fine blanking process, the excess materials may be filled into the round fillet, thereby reducing the production of burrs.

Figure 14:
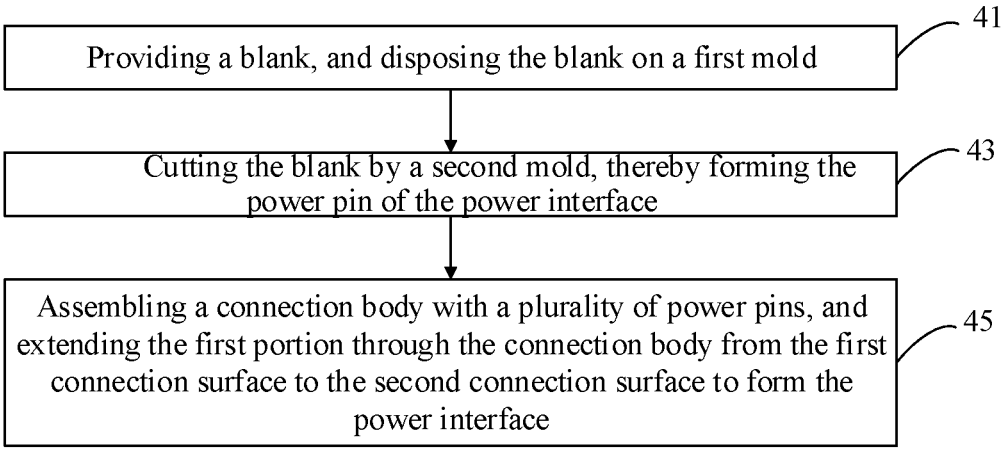
FIG. 14 is a flow chart illustrating a method for manufacturing the power interface according to another embodiment of the present disclosure.

In a further aspect, another method for manufacturing the power interface may be provided. FIG. 14 is a flow chart illustrating a method for manufacturing the power interface according to another embodiment of the present disclosure. FIGS. 15-18 are structural views corresponding to the method for manufacturing the power interface as shown in FIG. 14. In this embodiment, the power interface manufactured by the method is the power interface 100 described in the above embodiments, and may include a connection body 120 and a plurality of power pins 130. Likewise, referring to FIGS. 4 and 9, the connection body 120 may have a first connection surface 121 and a second connection surface 122 opposite to the first connection surface 121. Each of the plurality of power pin 130 may include a solid first portion 131 extending through the connection body 120 from the first connection surface 121 to the second connection surface 122. Likewise, the first portion 131 may extend beyond or completely embedded in the connection body 120. In one embodiment, as shown in FIG. 4, the first portion 131 may extend beyond the connection body 120, and may include the first outer surface 1312*a* located at one side of the connection body 120 and the second outer surface 1313*a* opposite to the first outer surface 1312*a* and located at the other side of the connection body. The first outer surface 1312*a* may extend beyond the first connection surface 121, and the second outer surface 1313*a* may extend beyond the second connection surface 122. In another embodiment, as shown in FIG. 9, the first portion 131 may be completely embedded in the connection body 120, and may include the third outer surface 131*a* and the fourth outer surface 131*b* opposite to each other. The third outer surface 131*a* may extend beyond the first connection surface 121, and the fourth outer surface 131*b* may extend beyond the second connection surface 122.

Referring to FIG. 14, the method in this embodiment may include the following blocks.

Figure 15:
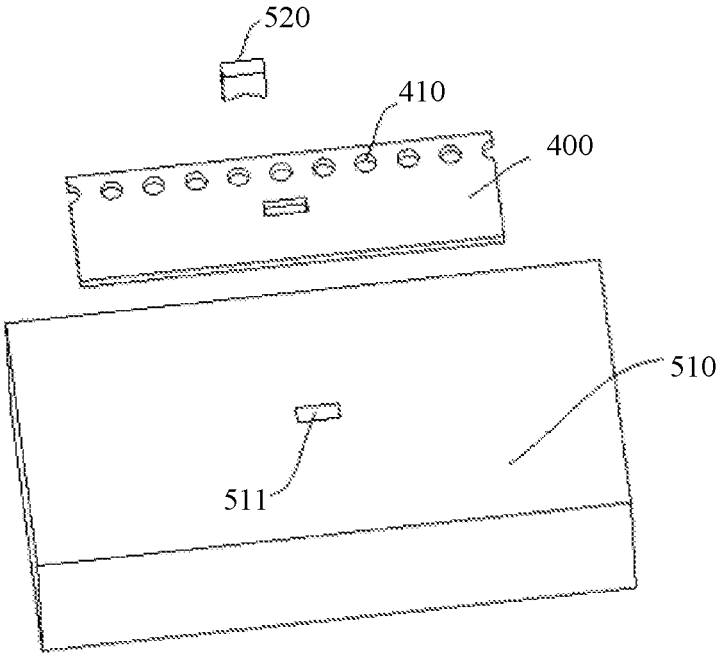
FIG. 15 is a structural view corresponding to the method for manufacturing the power interface as shown in FIG. 14.

At block 41: a blank 400 may be provided. The blank 400 may be disposed on a first mold 510. In this embodiment, as shown in FIG. 15, for the convenience of the positioning of the blank 400, a plurality of positioning holes 410 may be defined in the blank 400.

At block 43: the blank 400 may be cut by a second mold 520, thereby forming the power pin 130 of the power interface, as previously described. In this embodiment, the blank 400 may be cut by means of shearing.

At block 45: after a plurality of power pins 130 have been formed, the power interface 100 may be further formed by assembling the connection body 120 with a plurality of power pins 130 manufactured before, and extending the first portion 131 through the connection body 120 from the first connection surface 121 to the second connection surface 122.

The assembling method of the plurality of power pins 130 and the connection body 120 recited in the present embodiment may be similar to that disclosed in the embodiments shown in FIGS. 12-13, and will not be described in details any more.

According to the manufacturing method of the power interface according to the present embodiment of the present disclosure, the power pin may be formed by means of shearing. In this way, it is possible to omit the process of removing burs. Thus, the manufacturing cycle may be shortened, and the manufacturing cost may be saved.

Figure 16:
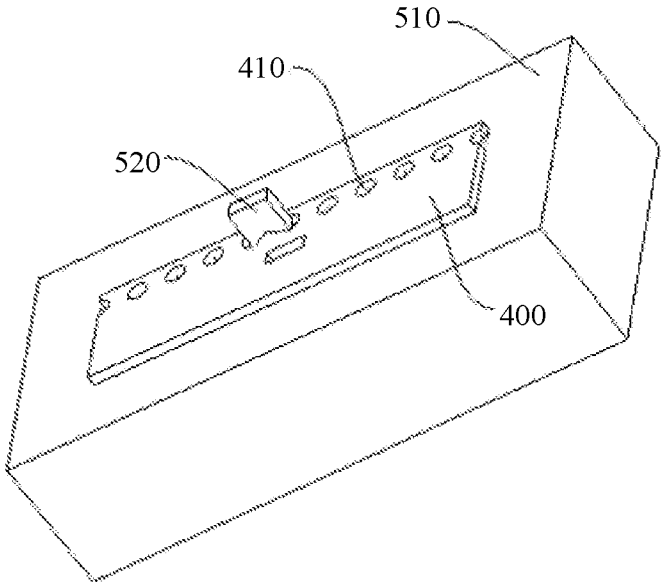
FIG. 16 is another structural view corresponding to the method for manufacturing the power interface as shown in FIG. 14.
Figure 17:
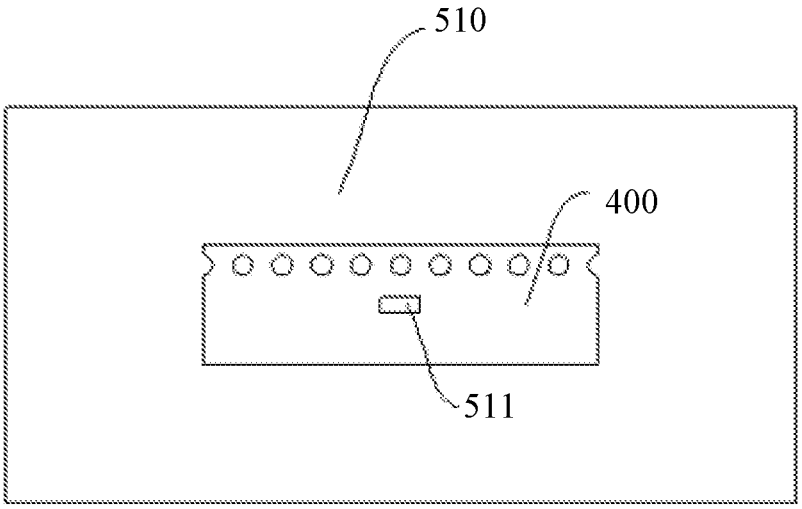
FIG. 17 is a further structural view corresponding to the method for manufacturing the power interface as shown in FIG. 14.
Figure 18:
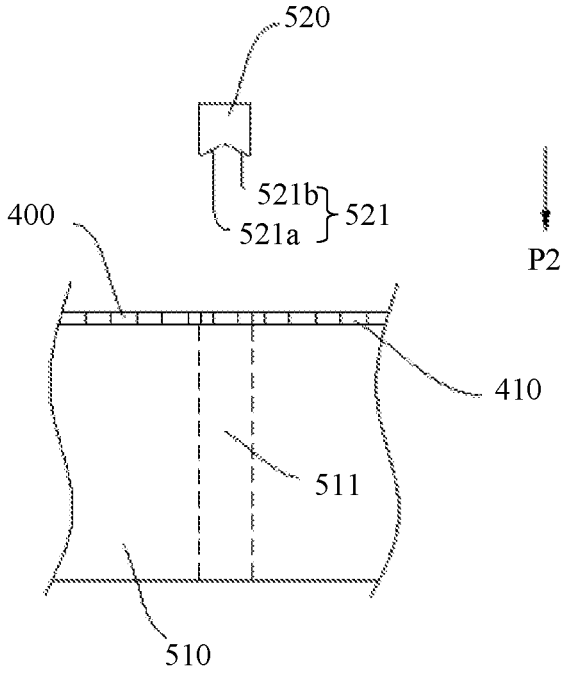
FIG. 18 is still a further structural view corresponding to the method for manufacturing the power interface as shown in FIG. 14.

Referring to FIGS. 16-18, in one embodiment of the present disclosure, a cutting groove 511 may be defined in the first mold 510. The cutting groove 511 may match with the second mold 520, such that a first outline of a first projection of an inner wall defining the cutting groove 511 on a plane substantially perpendicular to a second predefined cutting direction P2 may match with a second outline of a second projection of the second mold 520 on the same plane. That is, the first outline of the first projection of the inner wall defining the cutting groove 511 may have a same shape and size as the second outline of the second projection of the second mold 520 on the plane substantially perpendicular to the second predefined cutting direction P2. For example, on the plane substantially perpendicular to the second predefined cutting direction P2, the first outline of the first projection of the inner wall defining the cutting groove 511 may be in shape of a rectangle, and the second outline of the second projection of the second mold 520 may also in shape of a rectangle, and the first outline of the first projection of the inner wall defining the cutting groove 511 may be adapted to overlap with the second outline of the second projection of the second mold 520.

Referring to FIG. 18, in another embodiment, the second mold 520 may include a cutting surface 521 oriented towards the first mold 510. A middle portion of the cutting surface 521 may be recessed in a direction away from the first mold 510 (that is, opposite to the direction P2). In this way, it is possible to reduce the burs formed in the cutting process of the power pin 130. More specifically, as shown in FIG. 18, the cutting surface 521 may include a first inclined surface 521*a* and a second inclined surface 521*b* connected to the first inclined surface 521*a*. The first inclined surface 521*a* and the second inclined surface 521*b* may be gradually and continuously inclined in a direction from an edge of the cutting surface 521 to the middle portion and away from the first mold 510. In this way, a tip may be formed at the edge of the cutting surface 521, and thus it is possible to effectively reduce the burs from forming during the cutting process of the power pin 130.

Reference throughout this specification, the reference terms "an embodiment", "some embodiments", "one embodiment", "another example", "an example", "a specific example", or "some examples", and the like means that a specific feature, structure, material, or characteristic described in connection with the embodiment or example is included in at least one embodiment or example of the present disclosure. Thus, the illustrative descriptions of the terms throughout this specification are not necessarily referring to the same embodiment or example of the present disclosure. Furthermore, the specific features, structures, materials, or characteristics may be combined in any suitable manner in one or more embodiments or examples. In addition, one skilled in the art may combine the different embodiments or examples described in this specification and features of different embodiments or examples without conflicting with each other.

For one skilled in the art, it is clear that the present application is not limited to the details of the above exemplary embodiments, and that the present application can be implemented in other specific forms without deviating from the spirit or basic characteristics of the application. Therefore, at any point, the embodiments should be regarded as exemplary and unrestrictive, and the scope of the present application is defined by the appended claims, rather than the above description. Therefore, all changes within the meaning and scope of the equivalent elements of the claim is intended to be included. Any appended label recited in the claims shall not be regarded as a limitation to the claims. In addition, apparently, the terms "include", "comprise" and the like do not exclude other units or steps, and the singular does not exclude plural.

Although explanatory embodiments have been shown and described, it would be appreciated by one skilled in the art that the above embodiments previously described are illustrative, and cannot be construed to limit the present disclosure. Changes, alternatives, and modifications can be made in the embodiments without departing from scope of the present disclosure.

What is claimed is:

1. A power interface, comprising:

a connection body, having a first connection surface and a second connection surface disposed at two opposite sides of the connection body in a front-rear direction; and a plurality of power pins, each comprising a first portion extending through the connection body from the first connection surface to the second connection surface without dividing the first portion into a plurality of carts spaced apart from each other in the front-rear direction; wherein the first portion further extends in an up-down direction;

wherein a through-hole extends through each of the plurality of power pins along a left-right direction, and the through-hole is configured to facilitate forming the connection body on the plurality of power pins.

2. The power interface of claim 1, wherein the first portion comprises:

an embedding part, embedded in the connection body, a first extending part and a second extending part, formed integrally and continuously on two opposite sides of the embedding part in the left-right direction;

wherein the first extending part has a first outer surface extending beyond the first connection surface, and the second extending part has a second outer surface extending beyond the second connection surface;

wherein a first distance from the first outer surface to the second outer surface is greater than a second distance from the first connection surface to the second connection surface.

3. The power interface of claim 1, wherein the first portion is embedded in the connection body, and comprises a third outer surface located at one side of the connection body and a fourth outer surface located at the other side of the connection body; the third outer surface substantially flushes with the first connection surface, and the fourth outer surface substantially flushes with the second connection surface;

a third distance from the third outer surface to the fourth outer surface is substantially equal to a second distance from the first connection surface to the second connection surface.

4. The power interface of claim 1, further comprising a housing defining a receiving chamber configured to receive the connection body; wherein the connection body further comprises an engaging portion engaged with the housing.

5. The power interface of claim 1, wherein each of the plurality of power pins comprises a first coupling end configured to couple to a circuit board and a head end opposite to the first coupling end, and the through-hole is defined in a position near the head end and is in shape of a closed loop.

6. The power interface of claim 1, wherein each of the plurality of power pins is solid, and further comprises a second portion extending from an end of the first portion and along a length direction of the first portion; wherein the second portion is partially embedded in the connection body; the second portion comprises a first coupling end disposed at one end of the second portion that is away from the first portion and configured to couple to a circuit board.

7. The power interface of claim 6, further comprising a frame partially wrapped by the connection body; wherein each of the plurality of power pins further comprises a head end opposite to the first coupling end, and the head end contacts with the frame.

8. The power interface of claim 1, further comprising a frame partially wrapped by in the connection body and defining a receiving groove configured to receive the plurality of power pins.

9. The power interface of claim 8, wherein the connection body further comprises a pair of third connection surfaces opposite to each other in the left-right direction, and the pair of third connection surfaces are connected between the first connection surface and the second connection surface;

the frame comprises:

a frame body, defining the receiving groove;

a reinforcement, disposed in the frame body and connected to the frame body;

both the frame body and the reinforcement being wrapped by the connection body; and at least one protrusion, protruding out of the connection body from at least one of the pair of third connection surfaces and extending beyond the at least one of the pair of third connection surfaces.

10. The power interface of claim 9, wherein the frame further comprises a second coupling end configured to couple to a circuit board;

the at least one protrusion is arranged at one end of the frame that is away from the second coupling end.

11. The power interface of claim 1, wherein the housing further comprises on, or more first stopping plates and one or more second stopping plates received in the receiving chamber;

the one or more first stopping plates and the one or more second stopping plates are spaced apart from each other along the up-down direction;

the engaging portion is sandwiched between the one or more first stopping plates and the one or more second stopping plates.

12. The power interface of claim 11, wherein the number of the one or more first stopping plates is one, and the first stopping plate is annular and disposed around the circumference of the connection body; or the number of the one or more first stopping plates is two or more, and the first stopping plates are spaced from each other around the circumference of the connection body.

13. The power interface of claim 11, wherein the connection body comprises a connection portion, and the engaging portion extends around a circumference of the connection portion; each of the one or more second stopping plates is disposed on the engaging portion and has an opening configured to receive the connection portion;

wherein the power interface further comprises a first protrusion and a second protrusion;

the first protrusion is arranged at two opposite sides of the engaging portion in the left-right direction and extends away from the engaging portion in the left-right-direction;

the second protrusion is arranged at one side of the engaging portion in the front-rear direction and extends away from the engaging portion in the up-down direction.

14. A mobile terminal, comprising a power interface; wherein the power interface comprises:

a connection body, having a first connection surface and a second connection surface disposed at two opposite sides of the connection body in a front-rear direction; and a plurality of power pins, each comprising a first portion extending through the connection body from the first connection surface to the second connection surface without dividing the first portion into a plurality of parts spaced apart from each other in the front-rear direction; wherein the first portion extends in an up-down direction;

wherein a through-hole extends through each of the plurality of power pins along a left-right direction, and the through-hole is configured to facilitate forming the connection body on the plurality of power pins by means of injection.

15. The mobile terminal of claim 14, wherein the first portion is embedded in the connection body, and comprises a third outer surface located at one side of the connection body and a fourth outer surface located at the other side of the connection body; the third outer surface substantially flushes with the first connection surface, and the fourth outer surface substantially flushes with the second connection surface;

a third distance from the third outer surface to the fourth outer surface is substantially equal to a second distance from the first connection surface to the second connection surface.

16. The mobile terminal of claim 14, further comprising a frame partially wrapped by the connection body; wherein each of the plurality of power pins is solid, and further comprises a second portion partially embedded in the connection body and a head end opposite to the first coupling end; the second portion is formed integrally with the first portion, and comprises a first coupling end disposed at one end of the second portion that is away from the first portion and configured to couple to a circuit board; the head end contacts with the frame.

17. The mobile terminal of claim 14, wherein the first portion comprises:

an embedding part, embedded in the connection body, a first extending part and a second extending part, formed integrally and continuously on two opposite sides of the embedding part in the left-right direction;

wherein the first extending part has a first outer surface extending beyond the first connection surface, and the second extending part has a second outer surface extending beyond the second connection surface;

wherein a first distance from the first outer surface to the second outer surface is greater than a second distance from the first connection surface to the second connection surface.

18. The mobile terminal of claim 17, further comprising a frame partially wrapped by in the connection body and defining a receiving groove configured to receive the plurality of power pins; the frame comprises a second coupling end configured to couple to a circuit board, and at least one protrusion arranged at one end of the frame that is away from the second coupling end;

the connection body further comprises a pair of third connection surfaces opposite to each other, and the pair of third connection surfaces are connected between the first connection surface and the second connection surface; the at least one protrusion protrudes out of the connection body from at least one of the pair of third connection surfaces and extends beyond the at least one of the pair of third connection surfaces.

19. The mobile terminal of claim 17, further comprising a housing defining a receiving chamber configured to receive the connection body;

wherein the housing comprises one or more first stopping plates and one or more second stopping plates received in the receiving chamber;

the one or more first stopping plates and the one or more second stopping plates are spaced apart from each other along the up-down direction;

the engaging portion is sandwiched between the one or more first stopping plates and the one or more second stopping plates.

20. A power interface, comprising:

a connection body, having a first connection surface and a second connection surface disposed at two opposite sides of the connection body in a front-rear direction; and a plurality of power pins, each of which comprising a first portion and being partially wrapped by the connection body; wherein the first portion extends through the connection body from the first connection surface to the second connection surface in the front-rear direction without dividing the first portion into a plurality of parts spaced apart from each other in the front-rear direction, and the first portion further extends in an up-down direction;

wherein a through-hole extends through each of the plurality of power pins along a left-right direction without extending through each of the plurality of power pins along the up-down direction and the front-rear direction, and the through-hole is configured to facilitate forming the connection body on the plurality of power pins by means of injection.

* * * * *